US006205315B1

(12) United States Patent
Montfort et al.

(10) Patent No.: US 6,205,315 B1
(45) Date of Patent: Mar. 20, 2001

(54) TUNED TRANSDUCER, AND METHODS AND SYSTEMS FOR TUNING A TRANSDUCER

(75) Inventors: David B. Montfort, Webster; John R. Falvo, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/444,703

(22) Filed: Nov. 24, 1999

(51) Int. Cl.[7] ..... G03G 15/16
(52) U.S. Cl. ..... 399/319; 310/312
(58) Field of Search ..... 310/312, 320, 310/321, 322, 323.19; 399/319

(56) References Cited

U.S. PATENT DOCUMENTS

| | | | | |
|---|---|---|---|---|
| 3,599,124 | * | 8/1971 | Smith et al. | 333/32 |
| 4,987,456 | | 1/1991 | Snelling et al. . | |
| 5,005,054 | | 4/1991 | Stokes et al. . | |
| 5,010,369 | | 4/1991 | Nowak et al. . | |
| 5,016,055 | | 5/1991 | Pietrowski et al. . | |
| 5,081,500 | | 1/1992 | Snelling . | |
| 5,210,577 | | 5/1993 | Nowak . | |
| 5,245,245 | * | 9/1993 | Goldenberg | 310/330 |
| 5,515,148 | | 5/1996 | Montfort . | |
| 5,517,291 | | 5/1996 | Montfort et al. . | |
| 5,932,953 | * | 8/1999 | Drees et al. | 310/324 |
| 6,051,907 | * | 4/2000 | Ylilammi | 310/312 |

* cited by examiner

*Primary Examiner*—Robert Beatty
(74) *Attorney, Agent, or Firm*—Oliff & Berridge, PLC

(57) ABSTRACT

A transducer includes a vibratory energy producing element that generates vibratory energy and a waveguide member coupled to the vibratory energy producing element and transmitting the vibratory energy. The waveguide member has a longitudinal axis and is divided along the longitudinal axis into a plurality of waveguide segments. The transducer is tuned, i.e., brought into specification, by altering a mass of at least one of the waveguide segments relative to a mass of the other waveguide elements.

46 Claims, 12 Drawing Sheets

TUNED TRANSDUCER, AND METHODS AND SYSTEMS FOR TUNING A TRANSDUCER

BACKGROUND OF THE INVENTION

1. Field of Invention

This invention relates to methods and systems for tuning a transducer, and to transducers produced by such methods and systems.

2. Description of Related Art

In a typical electrophotographic printing process, a photoconductive member is initially charged to a substantially uniform potential and the charged portion of the photoconductive member is exposed to a light image of an original document being reproduced. Exposing the charged photoconductive member selectively dissipates the charge on the photoconductive member in the irradiated areas. Thus, an electrostatic latent image can be recorded on the photoconductive member corresponding to informational areas contained within the original document used to expose the photoconductive member. After the electrostatic latent image is recorded on the photoconductive member, the latent image is developed by bringing a developer material into contact with the photoconductive member. Generally, the developer material is made from toner particles adhering triboelectrically to carrier granules. The toner particles are attracted from the carrier granules to the latent image forming a developed image on the photoconductive member. The developed image is then transferred from the photoconductive member to a copy substrate, such as a sheet of paper.

Thereafter, heat or some other treatment is applied to the developed image to permanently affix the toner particles to the copy substrate. In a final step, the photoreceptive member is cleaned to remove any residual developing material on the photoconductive surface in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

Typically, the process of transferring charged toner particles from an image bearing support surface, such as a photoreceptor, to a second support surface, such as a copy sheet or an intermediate transfer belt, is enabled by overcoming adhesion forces holding the toner particles to the image bearing surface. In a conventional electrostatographic printing machine, toner images are transferred between support surfaces by electrostatic induction using a corona generating device. In this process, the second support surface is placed in direct contact with the developed toner image on the image bearing surface, while the back of the second support surface is sprayed with a corona discharge. The corona discharge generates ions having a polarity opposite that of the toner particles. This electrostatically attracts and transfers the toner particles from the image bearing surface to the second support surface.

A critical aspect of the transfer process focuses on applying and maintaining high intensity electrostatic fields and/or other forces in the transfer region to overcome the adhesive forces acting on the toner particles. These electrostatic fields and other forces need to be carefully controlled to induce the charged toner particles to physically detach and transfer to the second support surface without scattering or smearing of the developer material.

To enhance electrostatic toner release from an image bearing surface, recent systems have incorporated a transducer arranged along the back side of the image bearing surface. This transducer can generate focused vibratory energy that can be applied uniformly to the back side of the image bearing member. In such systems, toner transfer is enhanced due to the toner particles mechanically releasing from the image bearing surface. As a result, the toner particles will effectively transfer to the second support surface despite the electrostatic charges in the transfer zone being insufficient by themselves to attract the toner particles from the image bearing surface to the second support surface.

Exemplary systems of this nature are disclosed in U.S. Pat. No. 4,987,456 to Snelling et al.; U.S. Pat. No. 5,005,054 to Stokes et al.; U.S. Pat. No. 5,010,369 to Nowak et al.; U.S. Pat. No. 5,016,055 to Pietrowski et al.; U.S. Pat. No. 5,081,500 to Snelling et al.; and U.S. Pat. No. 5,210,577 to Nowak, each incorporated herein by reference in its entirety. As disclosed in U.S. Pat. No. 4,987,456, a transducer, or "resonator", that is able to generate focused vibratory energy generally includes a transducer element coupled to a resonating waveguide member. The waveguide member has a contacting tip that is brought into tension or penetration contact with the image bearing belt to couple the vibratory motion to the image bearing belt. In some systems which incorporate a transducer that applies uniform vibratory energy to the photoreceptor, widthwise slots are provided along the length of the transducer waveguide to segment the transducer into individually vibrating portions. This provides an increased velocity response across the waveguide, as well as improves the uniformity of the velocity. Such segmentation is disclosed in the incorporated references discussed above, among others. In these references, the waveguide portion is cut perpendicularly to the plane of the image bearing surface, and generally parallel to the direction of travel of the image bearing surface. This creates an open-ended slot between each segment, such that each segment acts more or less individually in response to the transducer.

SUMMARY OF THE INVENTION

However, there is a tendency for the response of the segmented waveguide segments to be elevated at one edge and/or to fall off along the opposite edge of the transducer as a result of the continuous mechanical behavior of the resonator device. The edges of the transducer correspond to marginal regions of the photoconductive member. These phenomena are commonly collectively called the "edge effect". However, uniform response along the entire device, arranged across the entire width of the imaging surface of the photoconductive member, is desirable.

This invention provides systems and methods for tuning a transducer so that it has an acceptably uniform response. If transducers can be thus tuned, substantial cost savings can be realized because virtually every transducer that is manufactured can be adjusted to operate within specified performance standards, resulting in very good yield.

Accordingly, in some exemplary embodiments, this invention provides a transducer that includes a vibratory energy producing element that generates vibratory energy, and a waveguide member coupled to the vibratory energy producing element. The waveguide member transmits the vibratory energy. The waveguide member has a longitudinal axis and is divided along the longitudinal axis into a plurality of waveguide segments. The waveguide segments may each have a same general size and shape. The transducer is tuned by altering a mass of at least one of the waveguide segments relative to a mass of the other waveguide elements. The altered mass may be either an increase in the mass or a decrease in the mass.

In other exemplary embodiments, this invention provides methods and/or systems for tuning a transducer. In the methods and systems of this invention, a velocity profile of the activated transducer is created, and at least one waveguide segment causing unacceptable velocity uniformity deviation is detected based on the velocity profile. In response, a mass of the at least one waveguide segment is altered as discussed above.

Methods and/or systems for tuning a transducer according to this invention may further include monitoring an impedance or an admittance of the activated transducer, detecting a bimodal response based on the monitored impedance or admittance, successively applying force to the individual waveguide segments until the bimodal response ceases, and determining that the waveguide segment to which force was applied when the bimodal response ceased is a waveguide segment of which the mass is to be altered.

Since a transducer can thus be tuned according to this invention, substantial cost savings can be realized because virtually every transducer that is manufactured can be adjusted to operate within specified performance standards, resulting in very good yield.

These and other features and advantages of this invention are described in or are apparent from the following detailed description of exemplary embodiments.

BRIEF DESCRIPTION OF THE DRAWINGS

Exemplary embodiments of this invention will be described in detail, with reference to the following figures, in which.

DETAILED DESCRIPTION OF EXEMPLARY EMBODIMENTS

This invention relates to transducers that are tuned to resonate such that a velocity uniformity deviation of the transducers is within a specified limit, and to methods and systems for tuning such transducers. In various exemplary embodiments of the systems, methods and transducers of this invention, mass is added to one or more transducer waveguide segments that are causing large velocity uniformity deviations. In other exemplary embodiments of the systems, methods and transducers of this invention, mass is subtracted from one or more transducer waveguide segments that are causing large velocity uniformity deviations. In still other exemplary embodiments, mass is added to at least one waveguide segment and mass is subtracted from at least one other waveguide segment.

Figure 1:
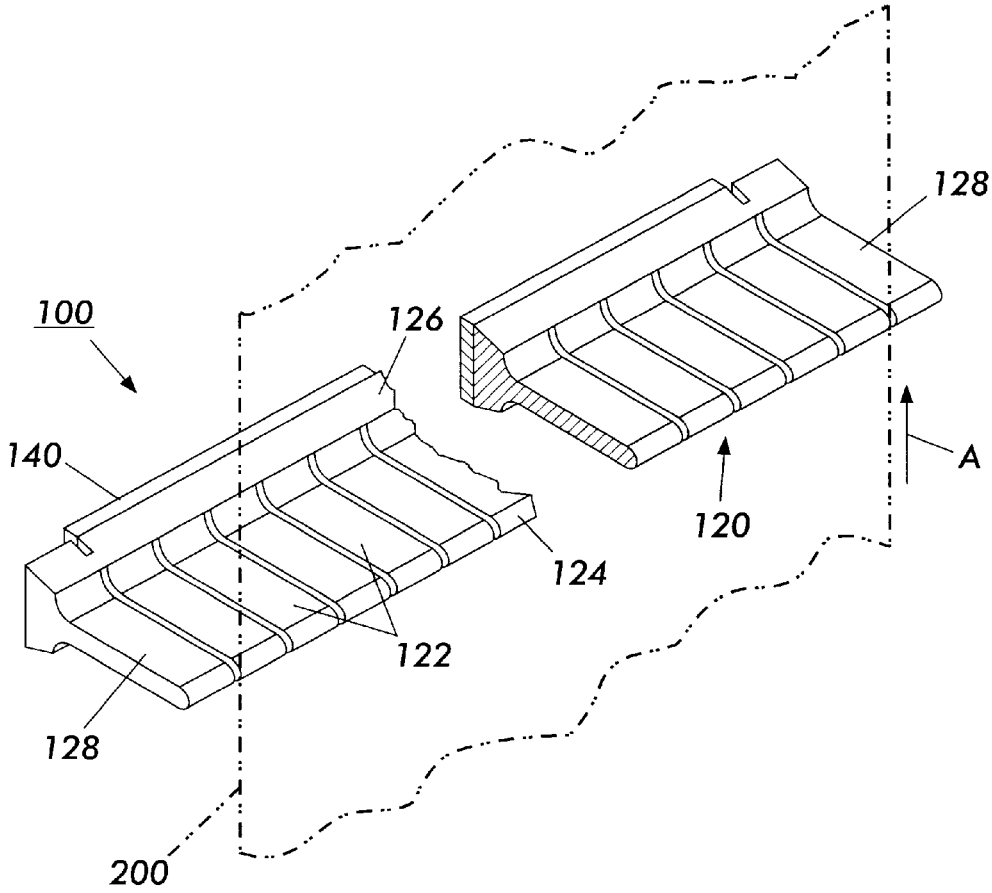
FIG. 1 PRIOR ART
FIG. 1 shows an example of a conventional transducer.

FIG. 1 shows an example of a conventional transducer 100. This transducer is described more fully in U.S. Pat. No. 5,515,148, incorporated herein by reference in its entirety.

The transducer 100 includes a vibratory energy producing element 140, such as a piezoelectric transducer block. The vibratory energy producing element 140 is driven by an AC voltage source. The vibratory energy producing element 140 is generally operated at a frequency between 20 kHz and 200 kHz, and typically operated at approximately 60 kHz. A waveguide member 120 is coupled to the vibratory energy producing element 140 to transmit the vibratory energy generated by the vibratory energy producing element 140 to a belt 200. The vibratory energy producing element 140 is shown as a single piezoelectric transducer block, but may be formed by a plurality of separate piezoelectric transducer blocks. An adhesive epoxy and conductive mesh layer or other materials, as discussed, for example, in U.S. Pat. No. 5,517,291, the disclosure of which is incorporated herein by reference in its entirety, may be used to bond the transducer and waveguide elements together without requiring additional mechanical coupling devices.

In one exemplary embodiment, the waveguide member 120 is fabricated from aluminum. The waveguide member 120 has a platform portion 126 and a contacting tip 124 that contacts belt 200 to impart the vibratory energy of the vibratory energy producing element 140 to the belt 200. Various shapes and structures have been considered for the waveguide member 120, as discussed in U.S. Pat. No. 4,987,456. Thus, while FIG. 1 shows a "stepped horn" waveguide member 120, it will be understood that other shapes, such as an exponential shape, a conical shape, or the like, may also be used for the waveguide member 120.

In addition, in accordance with known transducers used in the electrostatographic printing arts, a portion of waveguide member 120 is cut perpendicularly to the plane of the photoconductive surface, and generally parallel to the process direction of travel of the photoconductive surface. However, the cuts do not extend through the platform portion 126. Therefore, this arrangement produces an array of waveguide segments 122 along a longitudinal axis of the transducer 100. It should also be appreciated that the velocity response across the segmented tip configuration shown in FIG. 1 is greater than that of an unsegmented tip, which is a desirable result.

The transducer 100 may include "dead" or inactive end segments 128 located at opposite ends of the waveguide member 120. The inactive end segments 128 help in mitigating the "edge roll-off effect", as described in U.S. Pat. No. 5,515,148. In addition, the inactive end segments 128 may be used as non-interactive mounting points.

Figure 2:
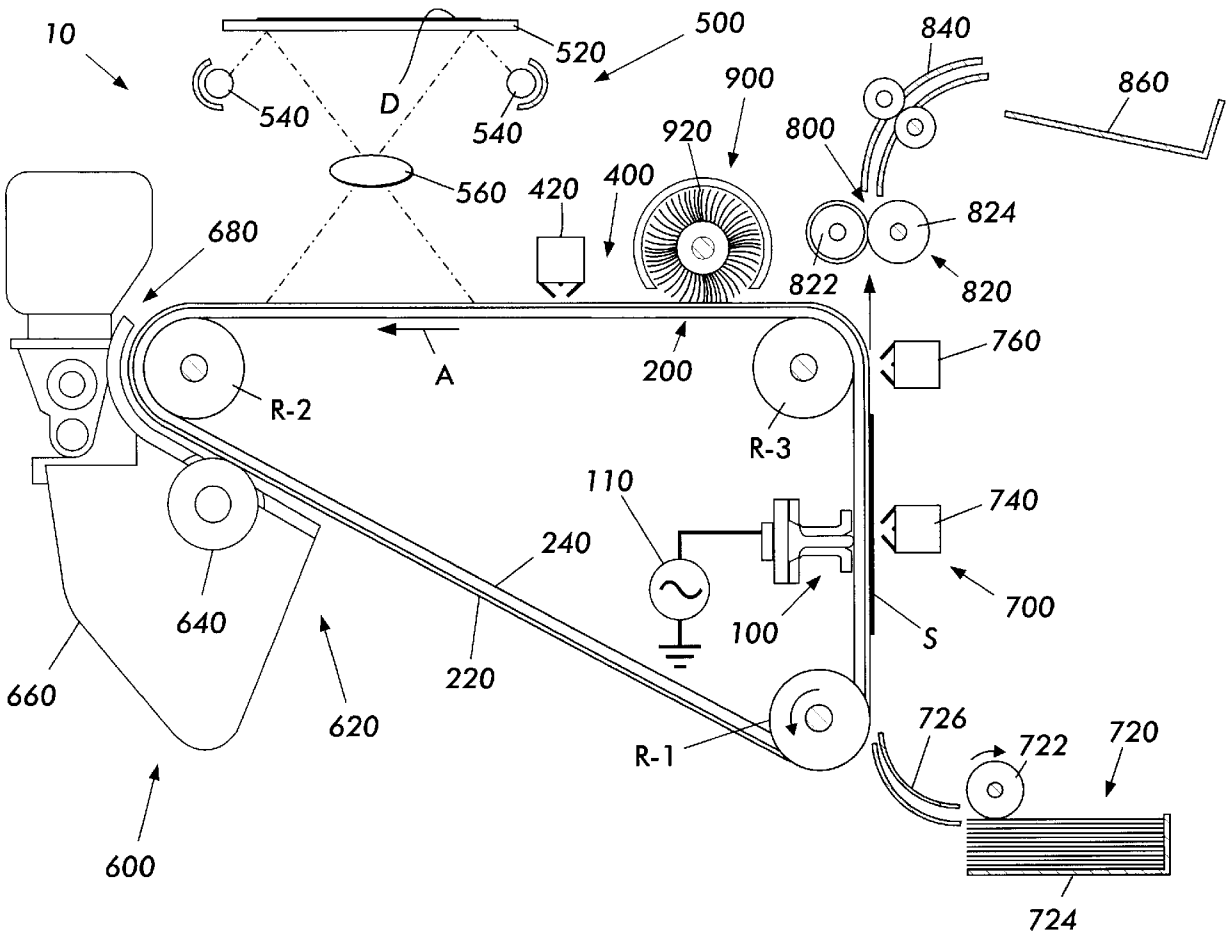
FIG. 2 PRIOR ART
FIG. 2 shows an example of a conventional image reproducing system incorporating the transducer of FIG. 1.

FIG. 2 shows an example of a conventional image reproducing apparatus 10 that can incorporate the transducer 100 shown in FIG. 1. Specifically, the image reproducing apparatus 10 shown in FIG. 2 is an automatic electrophotographic reproducing machine.

The transducer of this invention is particularly useful in a transfer subsystem in an automatic electrophotographic reproducing machine as shown in FIG. 2. The transducer of this invention is also well suited for use in a wide variety of electrostatographic processing machines, as well as many other known printing systems. It will be further understood that the tuned transducer of this invention is not necessarily limited in its application to a transfer subsystem and thus may also be useful in other subsystems in which particle adhesion/cohesion forces are desirably reduced, such as development or cleaning subsystems, for example.

As shown in FIG. 2, the electrophotographic reproducing apparatus 10 employs the belt 200. The belt 200 includes a photoconductive surface 220 deposited on an electrically grounded conductive substrate 240. A drive roller R-1 is coupled to a motor (not shown) by any suitable means, as for example a drive belt, and is further engaged with belt 200 to drive the belt 200 in a process direction, as indicated by arrow A. The process direction A is a curvilinear path defined by drive roller R-1 and rotatably mounted tension rollers R-2 and R-3. This system of rollers R-1, R-2, R-3 is used to advance successive portions of the photoconductive surface 220 through various processing stations. These various processing stations are disposed about the path of movement of the belt 200.

Initially, a segment of belt 200 passes through a charging station 400. At the charging station 400, a corona generating device 420, or any other known or later-developed charging apparatus, charges the photoconductive surface 220 to a relatively high, substantially uniform potential.

Once charged, the photoconductive surface 220 advances to an imaging station 500 where an original document D, positioned face down upon a transparent platen 520, is exposed to a light source 540. Light rays from the light source 540 are reflected from the original document D and transmitted through a lens 560 to form a light image of the original document D on the charged portion of the photoconductive surface 220. The light image selectively dissipates the charge on the photoconductive surface 220 in areas corresponding to non-image areas on the original document D. This forms a latent electrostatic image of the original document D on photoconductive surface 220.

Although an optical imaging system has been shown and described that forms the light image of information used to selectively discharge the charged photoconductive surface 220, it should be appreciated that a properly modulated scanning beam of energy, such as a laser beam or other means, may be used to irradiate the charged portion of the photoconductive surface 220 to form the latent electrostatic image.

After the latent electrostatic image is formed on the photoconductive surface 220, the belt 200 advances to a development station 600, where a magnetic brush development system 620 deposits particulate toner material onto the latent electrostatic image. In the exemplary embodiment of the image reproducing apparatus 10 shown in FIG. 2, the magnetic brush development system 620 includes a developer roll 640 disposed in a developer housing 660. Toner particles are mixed with carrier beads in the developer housing 660, generating an electrostatic charge that causes the toner particles to cling to the carrier beads. The magnetic developer roll 640 is rotated in the developer housing 660 to attract the beads of toner. This forms a "brush", where the carrier beads, with the toner particles, are magnetically attached to the developer roll 640. As the developer roll 640 continues to rotate, the brush contacts the belt 200, where the toner particles are brought into contact with the photoconductive surface 220. The latent electrostatic image attracts the toner particles from the developer roll 640 to develop the latent electrostatic image into a visible image. A toner particle dispenser 680 furnishes a supply of additional toner particles to the housing 660.

After the toner particles have been deposited onto the electrostatic latent image to create the developed toner image, the belt 200 advances the developed image to a transfer station 700. At the transfer station 700, a sheet of support material S, such as paper or some other type of copy sheet or substrate, is moved into contact with the developed toner image on the belt 200 using a sheet feeding apparatus 720 and a chute 726 to synchronously place the sheet S into contact with the developed toner image. In various exemplary embodiments, the sheet feeding apparatus 720 includes a feed roller 722 that rotates while frictionally contacting the uppermost sheet of a stack 724 to advance the sheets of support material S into chute 726. The chute 726 guides the sheets of support material S into contact with photoconductive surface 220 of the belt 200. The developed image on the photoconductive surface 220 thereby contacts the advancing sheet of support material S in a precisely timed sequence at the transfer station 700. A corona generating device 740 charges the support material S to a potential so that the toner image is attracted from the photoconductive surface 220 of photoreceptor belt 200 to the support material S while the support material S is also electrostatically tacked to photoreceptor belt 200.

The exemplary transfer station 700 shown in FIG. 2 includes the vibratory energy producing device or transducer 100 of FIG. 1. The transducer 100 is arranged in vibratory relationship with the back side of belt 200 at a position corresponding to the location of the corona generating device 740 to apply vibratory energy to the belt 200 and to agitate the toner particles of the developed image to mechanically release the toner particles from the photoconductive surface of the belt 200. The vibratory energy supplied by the transducer 100 enhances toner transfer by dissipating the attractive forces between the toner particles and the belt 200. In various exemplary embodiments of the transducer 100, the vibrating surface of the transducer 100 is parallel to the photoreceptor belt 200 and transverse to the direction of belt movement A. The belt 200 is sufficiently flexible that the belt 200 will be affected by the vibrating motion of the transducer 100.

Vibratory assisted transfer, as provided by the transducer 100, also provides increased transfer efficiency with lower-than-normal transfer fields. Such increased transfer efficiency not only yields better copy quality, but also results in improved toner use and a reduced load on the cleaning system.

After the transfer step is completed, a corona generator 760 charges the support material S with an opposite polarity to release the support material from the belt 200. As a result, the support material S can be stripped from the belt 200. The support material S is subsequently separated from the belt 200 and transported to a fusing station 800. It should be appreciated that the support material S may also be an intermediate surface or member that carries the toner image to a subsequent transfer station for transfer to a final support surface. These types of surfaces are also charge retentive in nature. Further, while the exemplary embodiments discussed herein use belt-type photoconductive members, it will be recognized that other substantially nonrigid or compliant members may also be used with the tuned transducer according to this invention.

The fusing station 800 includes a fuser assembly 820 comprising a heated fuser roll 822 and a support roll 824 spaced relative to one another to receive a sheet of support material S. The toner image is forced into contact with the support material S by the fuser rolls 822 and 824 to permanently affix the toner image to the support material S. After fusing, a chute 840 directs the advancing sheet of support material S to a receiving tray 860 for subsequent removal of the finished copy by an operator.

After the support material S is separated from the belt 200, some residual toner normally remains adhered to the photoconductive surface 220. Thus, a cleaning station 900 is provided to remove the residual toner particles from the photoconductive surface 220. The cleaning station 900 includes a rotatably mounted fibrous brush 920 that physically engages the photoconductive surface 220 to remove the remaining toner particles. Removed toner particles are stored in a cleaning housing chamber (not shown). The cleaning station 900 can also include a discharge lamp (not shown) to flood the photoconductive surface 220 with light to dissipate any residual electrostatic charge remaining on the photoconductive surface. The cleaning station 900 may also include a vibratory resonator arranged in a manner similar to the transducer 100 to help remove toner particles from the belt 200.

Figure 3:
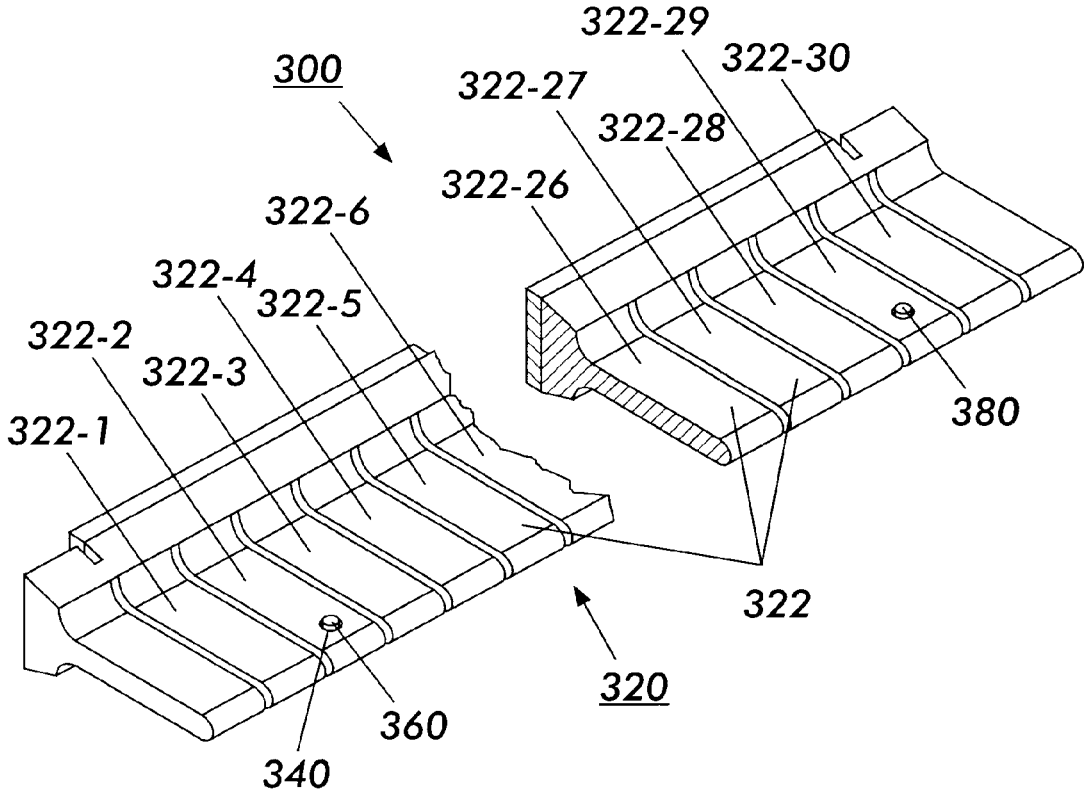
FIG. 3 shows an exemplary embodiment of a transducer according to this invention.

FIG. 3 shows one exemplary embodiment of a tuned transducer 300 according to this invention. The transducer 300 is similar to the transducer 100 shown in FIG. 1, except that one or more of the waveguide segments 322 have an altered mass relative to other ones of the waveguide segments 322.

Specifically, in the exemplary embodiment shown in FIG. 3, thirty waveguide segments 322-1 through 322-30 are provided on the transducer 300. Two waveguide segments 322-2 and 322-29 have altered masses with respect to the other waveguide segments 322. Specifically, the waveguide segment 322-2 has mass increasing members 340 and 360 attached to it, and the waveguide segment 322-29 has a mass decreasing cavity 380 formed in it.

The mass increasing members 340 and 360 may be provided in many different forms. For example, good results have been obtained using adhesive Teflon tape. Another potentially good form is a hardenable adhesive. In this case, in various exemplary embodiments, the hardenable adhesive has a low temperature sensitivity. In other words, the performance characteristics of the hardenable adhesive do not vary greatly with temperature. For example, an epoxy such as Emerson and Cuming Stycast A24 epoxy with 24 LV catalyst @ 100:16.5 mix ratio may be used.

Other forms include mass increasing materials, such as lead or the like, attached to the waveguide segments 322 in any suitable manner. For example, if the mass increasing material has a density greater than that of the material of the waveguide segments 322, a cavity may first be formed in each target waveguide segment 322. Then, the mass increasing material may be bonded and/or packed into the cavity, much like a dental filling in a tooth.

In the exemplary embodiment of the tuned transducer 300 shown in FIG. 3, the mass increasing members 340 and 360 have different sizes. However, mass increasing members 340 and 360 may, if desired or appropriate, have the same size. In the exemplary embodiment of the tuned transducer 300 shown in FIG. 3, the mass increasing members 340 and 360 are positioned near a distal end of the waveguide segment 322-2, for greatest effect. However, the mass increasing members 340 and 360 may be located elsewhere on the waveguide segment 322-2.

The mass decreasing cavity 380 may be formed by any suitable method, such as by boring, grinding, forming the cavity during a molding process used to form the waveguide member 320, or the like. Furthermore, the mass decreasing cavity 380 may be of any desired or appropriate shape or configuration. The mass decreasing cavity 380 is positioned near a distal end of the waveguide segment 322-29, for greatest effect. However, the mass decreasing cavity 380 may be located elsewhere on the waveguide segment 322-29.

The transducer 300 shown in FIG. 3 includes mass increasing members 340, mass increasing members 360 and mass decreasing cavities 380. However, it should be appreciated that only one of mass increasing members 340, mass increasing members 360 and mass decreasing cavities 380, or only two of mass increasing members 340, mass increasing members 360 and mass decreasing cavities 380, may be necessary for a given tuned transducer 300. For example, one tuned transducer 300 may be tuned using only mass decreasing cavities 380, while another tuned transducer 300 may be tuned using only one of mass increasing members 340 or 360, while yet another tuned transducer 300 may be tuned using both mass decreasing cavities 380 and one or the other, or both, of mass increasing members 340 and 360. Any suitable combination of mass increasing members 340 and/or 360 and mass decreasing cavities 380 is appropriate and is within the scope of this invention.

Furthermore, while only waveguide segments 322-2 and 322-29 have altered masses in the exemplary embodiment of the tuned transducer shown in FIG. 3, it should be appreciated that others of the waveguide segments 322 may also be provided with altered masses.

Figure 4:
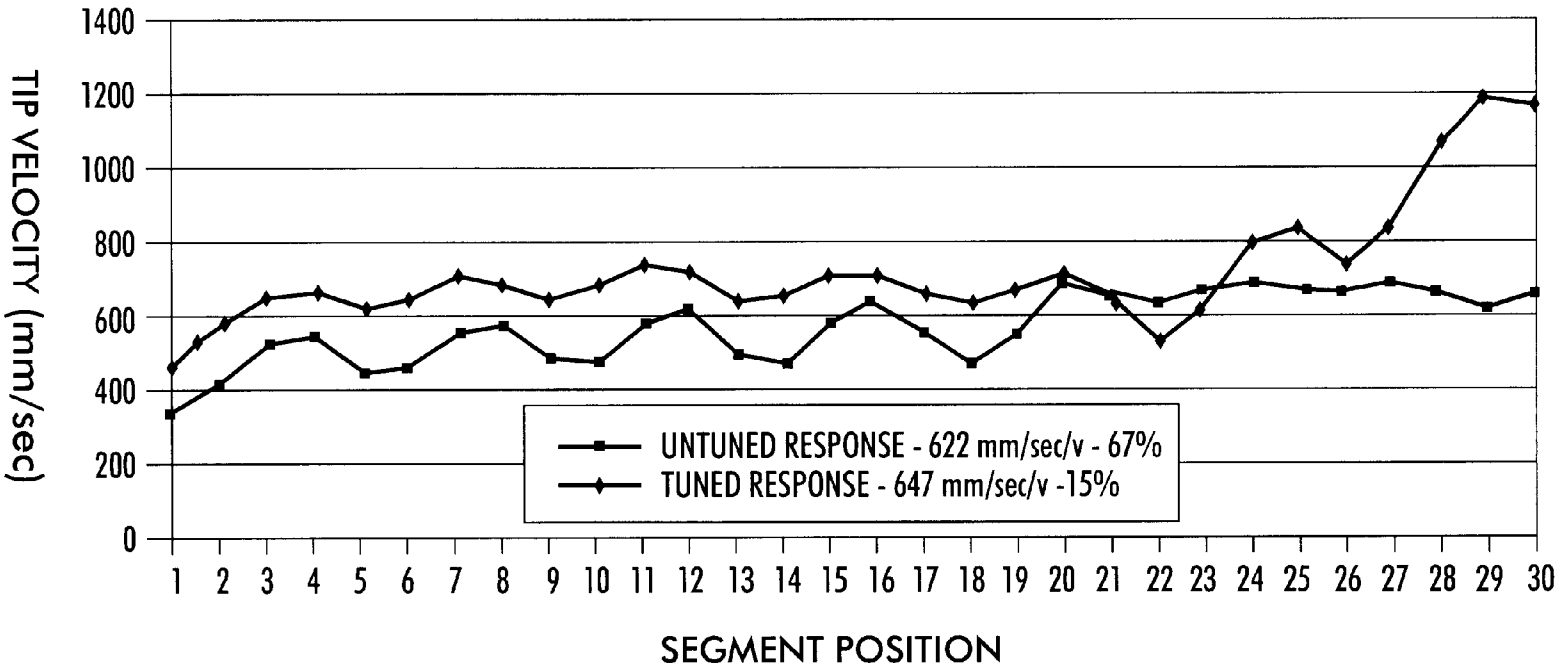
FIG. 4 shows an exemplary velocity profile of a transducer, before and after being tuned according to this invention.

FIG. 4 shows an example of a velocity profile of a transducer, before and after being tuned according to this invention. The velocity profile can be obtained using a non-contact-type velocometer, such as the Polytek laser vibrometer, although it should be appreciated that other systems and methods for obtaining a velocity profile could also be used. In the exemplary embodiment of the graph shown in FIG. 4, the velocity was measured at the tip of each waveguide segment.

Before being tuned, the transducer used to generate the graph of FIG. 4 had a velocity uniformity deviation of 67%. After being tuned, this transducer had a velocity uniformity deviation of only 15%. When applied in an image reproduction apparatus of the type shown in FIG. 2, a velocity uniformity deviation of 20% or less is acceptable. For other applications, greater or more limited velocity uniformity deviations may be permissible.

In untuned transducers, a bimodal frequency response can often be observed, indicative of a multi-resonant device. Such a bimodal response makes it impossible for the power source to accurately lock on to a singular resonant frequency to drive the transducer, or in other words, to determine the frequency at which the transducer should be driven. One object of the tuning process is to eliminate such a bimodal response.

Figure 5:
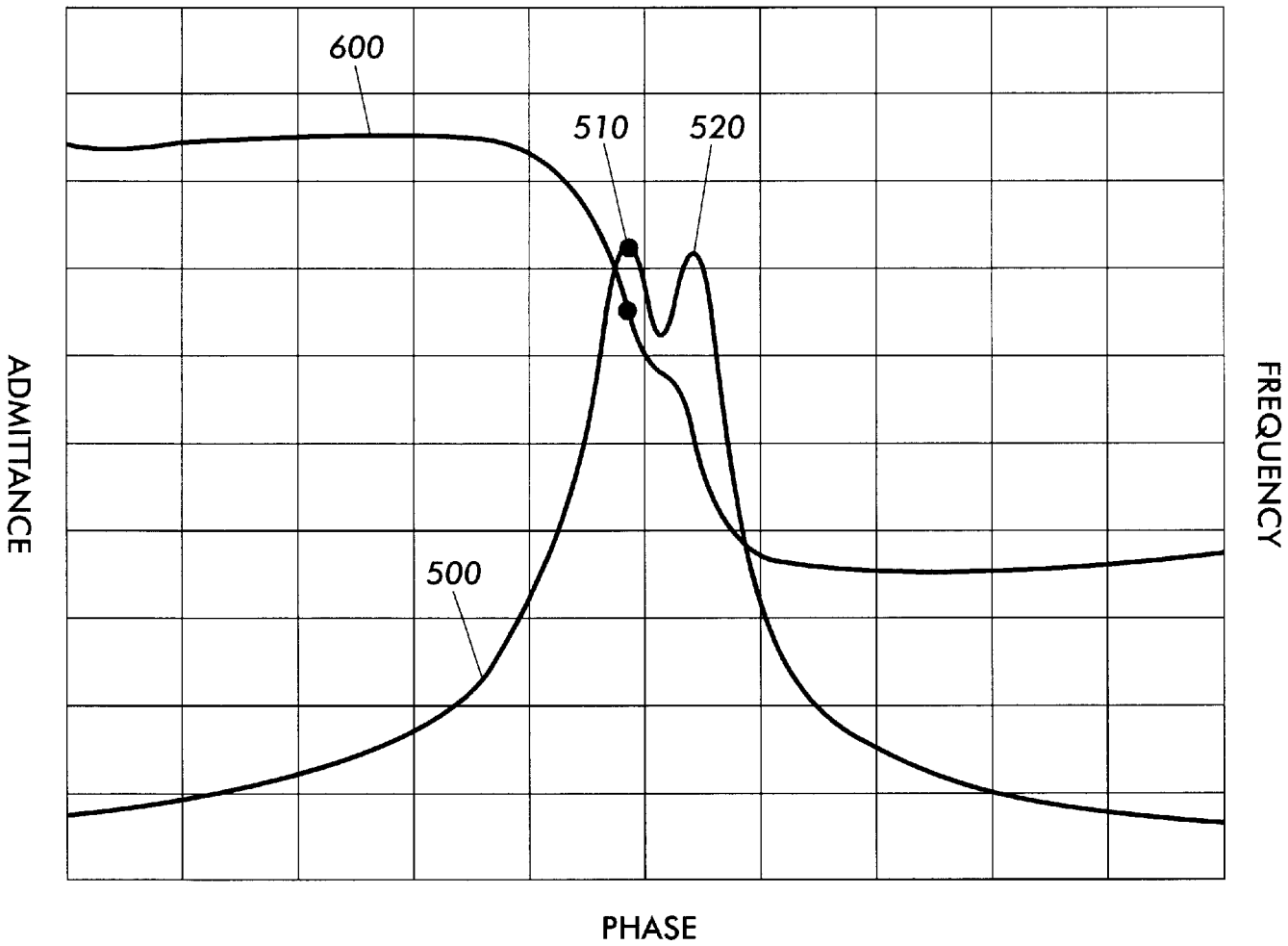
FIG. 5 is a phase/frequency/admittance plot that shows an example of a bimodal response in an untuned transducer.

FIG. 5 shows a bimodal response of a transducer. Curve 500 shows admittance, while curve 600 is a phase trace that shows the phase between the current and the voltage driving the transducer. The bimodal response is manifested as two peaks 510 and 520 in the admittance curve 500.

Figure 6:
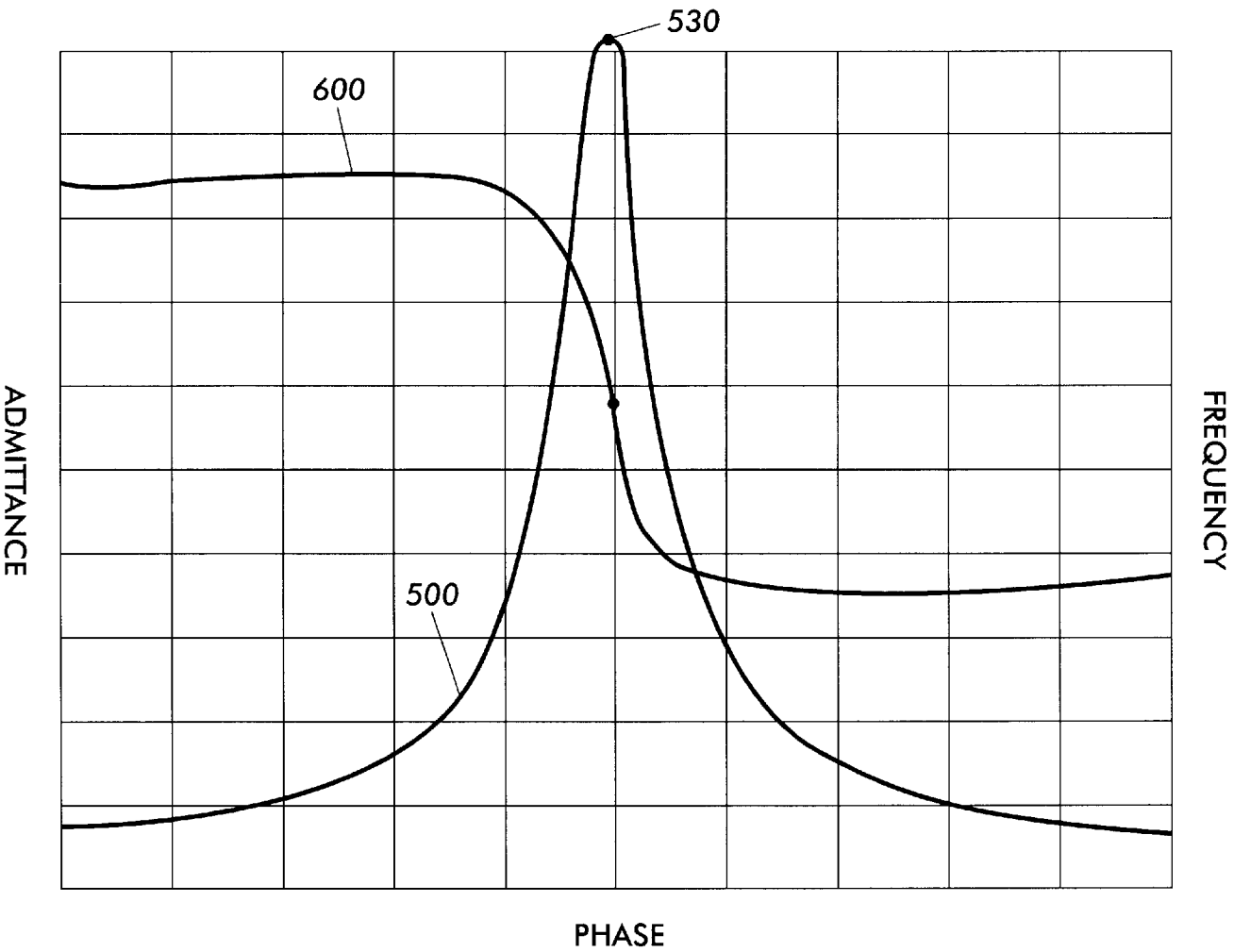
FIG. 6 is a phase/frequency/admittance plot that shows the absence of a bimodal response in a transducer that has been tuned according to this invention.

FIG. 6 shows the response after the transducer used to generate the graph of FIG. 5 has been tuned or otherwise manipulated, as described herein, to reduce, if not eliminate, the bimodal response. In FIG. 6, only one peak, the peak 530, is present. Therefore, a bimodal response is no longer present in this transducer.

To facilitate the tuning process, and/or to provide a "pre-balancing" step, a transducer can be analyzed by an admittance analyzer. The admittance analyzer analyzes admittance curves to identify bimodal responses, such as that shown in FIG. 5. While the admittance is being monitored, a small force can be applied to one of the waveguide segments 322. If the bimodal response disappears while the force is applied, the particular waveguide segment to which force was applied needs to have its mass altered.

In particular, when a bimodal response is present, the bimodal response can typically be reduced by applying force to either the second waveguide segment 322-2 or the twenty-ninth waveguide segment 322-29, when the transducer has thirty waveguide segments as shown in FIG. 3 and is approximately 15" long. If more or less than thirty waveguide segments are present, if the length is different, if a different material is used, and/or if the shape of the waveguide segments is different, it may be necessary to apply force to a waveguide segment other than the second or twenty-ninth segment to eliminate the bimodal response. However, among any group of identical transducers, the position of the waveguide segment or segments to which force must be applied to eliminate a bimodal response should remain consistent from segment to segment within the group.

To apply force to reduce the bimodal response, an operator may simply lightly press down on a waveguide segment with his or her finger. Alternatively, an automatic system may be used. For example, a mechanical force applying mechanism may be actuated by an electrical controller, and the controller may be electrically connected to the admittance analyzer. The controller controls the force applying mechanism to apply force to a certain waveguide segment, for example, the waveguide segment 322-2. The controller then detects whether the admittance analyzer has ceased to observe a bimodal response. If the admittance analyzer has not ceased to observe a bimodal response, the controller controls the force applying mechanism to apply force to another waveguide segment, for example, the waveguide segment 322-29. If necessary, this process is repeated until the bimodal response has been reduced or eliminated.

Once the bimodal response has been reduced or eliminated and a target waveguide segment 322 which needs to have its mass altered is thus detected, the mass is altered by adding to or deleting from the mass of that waveguide segment 322 as described above. The mass can be increased or decreased by any desired amount. However, in various exemplary embodiments, since this is only a pre-balancing step, the mass is altered by a predetermined amount. For example, reducing the mass of the target waveguide segment by boring a 1 mm hole through the target waveguide segment is effective.

Although the various exemplary embodiments described above use the admittance to observe a bimodal response, it should be appreciated that impedance, which is the inverse of admittance, may also be used to observe a bimodal response.

After pre-balancing the transducer by altering the mass of the target waveguide segment 322 as described above, a velocity profile is created.

Figure 7:
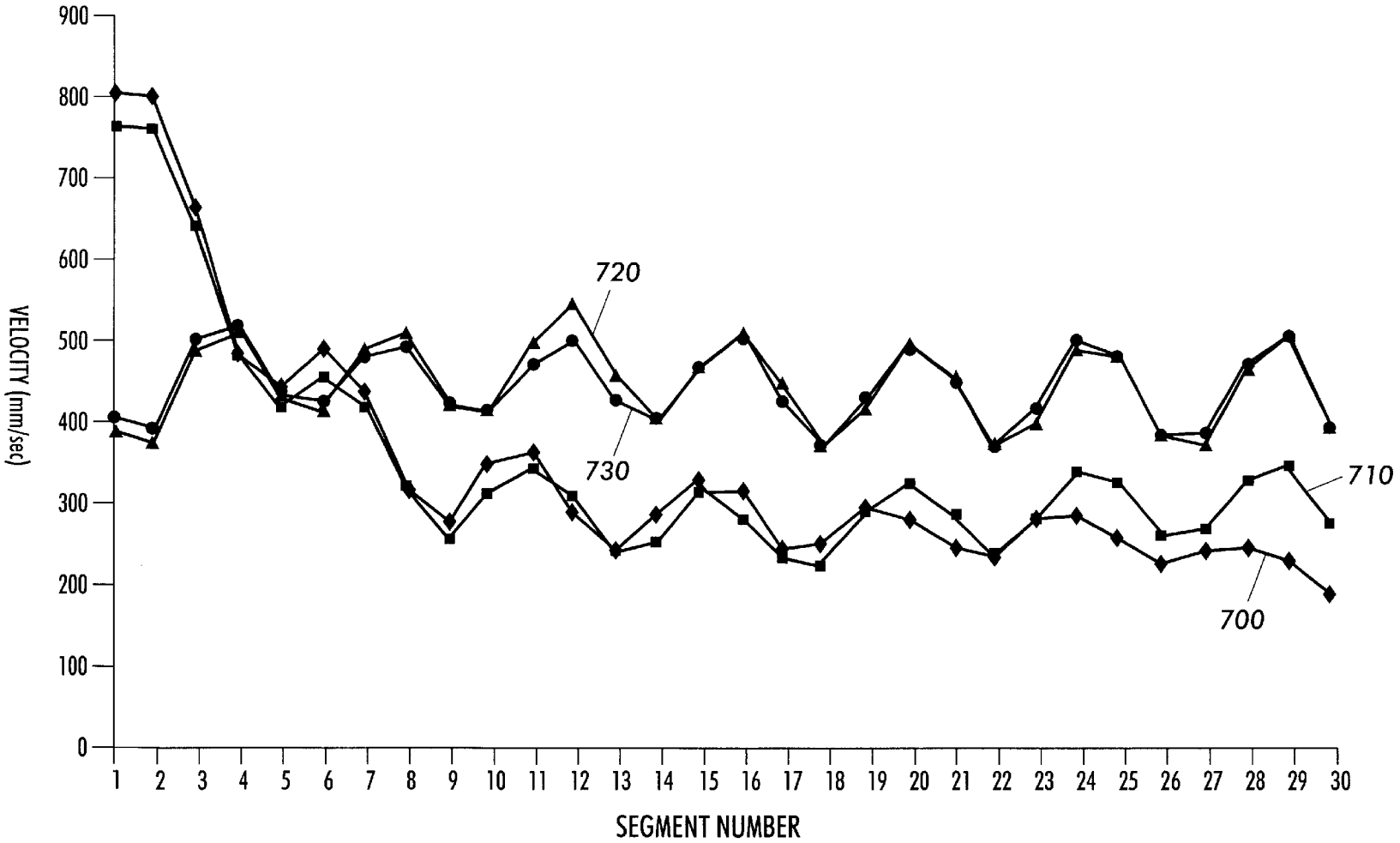
FIG. 7 shows velocity profiles at various stages of tuning a transducer according to this invention.

FIG. 7 shows velocity profiles at various stages of tuning a transducer according to this invention. Specifically, the curve 700 shows an initial velocity profile of a particular transducer, before any tuning has been performed. As shown in FIG. 7, one end of the transducer, corresponding to the left side of the velocity profile, has a velocity of about 800 mm/sec, while the other end has a velocity of about 200 mm/sec. The velocity uniformity deviation for this transducer at this point was 62.6%, which is unacceptable for most applications.

The curve 710 shows a velocity profile of the same transducer after an initial mass removal was performed at segment 322-29. Specifically, in this case, a 1 mm diameter hole was bored through the twenty-ninth waveguide segment 322-29 to decrease its mass. As a result, in the curve, the velocity of the left side of the transducer has decreased to slightly over 750 mm/sec, while the right side velocity has increased to about 275 mm/sec. The velocity uniformity deviation at this point is 55.4%, which is an improvement, but which is still outside the acceptable range for most applications.

The curve 720 shows a velocity profile of the same transducer after further tuning has been performed. Specifically, approximately 150 mg of mass has been added to the second waveguide segment 322-2. This has brought the velocity of the left side of the transducer down to about 400 mm/sec, and has raised the right side velocity to about 400 mm/sec. The velocity uniformity deviation at this point is 19.8%, which is within a generally acceptable range. However, the curve indicates that the twelfth waveguide segment 322-12 is noticeably out of uniformity with respect to the other waveguide segments.

In order to improve the response of the twelfth waveguide segment 322-12, a 12.8 mg mass is added to the waveguide segment 322-12. The resulting velocity profile is shown in the curve 730. The velocity uniformity deviation is now only 16.6%.

Figure 8:
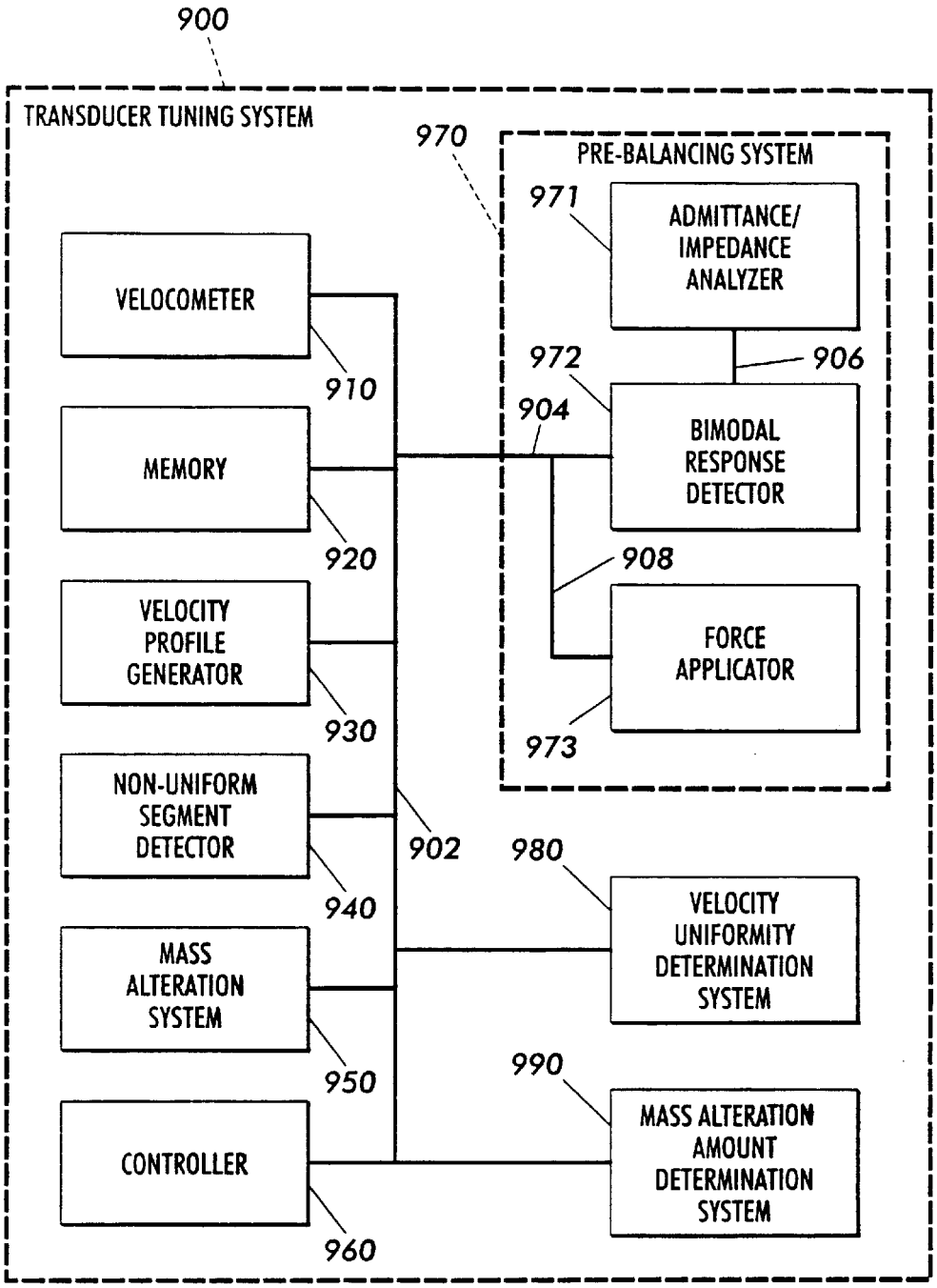
FIG. 8 is a functional block diagram of one exemplary embodiment of a transducer tuning system according to this invention.

FIG. 8 is a functional block diagram of one exemplary embodiment of a transducer tuning system 900 according to this invention. The transducer tuning system 900 includes at least a velocometer 910, a memory 920, a velocity profile generator 930, a non-uniform segment detector 940, a mass alteration system 950 and a controller 960. The velocometer 910, the memory 920, the velocity profile generator 930, the non-uniform segment detector 940, the mass alteration system 950 and the controller 960 are electrically and/or functionally interconnected by a data/control bus 902.

The velocometer 910 scans velocities of the individual waveguide segments 322 of a transducer 300. These individual velocities are stored in the memory 920. The velocity profile generator 930 then generates a velocity profile based on the velocities stored in the memory 920.

Based on the velocity profile, and/or on information from a pre-balancing system 970, described below, the non-uniform segment detector 940 identifies at least one waveguide segment 322 that has non-uniform velocity with respect to the other waveguide segments 322.

The mass alteration system 950, which may include either or both of a mass increasing system and a mass decreasing system, then alters the mass of one or more of the at least one identified non-uniform waveguide segment 322 based on the velocity profile and/or on information from the pre-balancing system 970, described below.

The controller 960 exerts control as needed to enable the velocometer 910, the memory 920, the velocity profile generator 923, the non-uniform segment detector 940 and the mass alteration system 950 to accomplish their respective functions.

The transducer tuning system 900 may also include a pre-balancing system 970, a velocity uniformity determination system 980 and/or a mass alteration amount determination system 990, which may also be interconnected with other elements of the transducer tuning system 900 via the data/control bus 902.

The pre-balancing system 970 may include an admittance analyzer or, alternatively, an impedance analyzer 971, a bimodal response detector 972 and a force applicator 973. The admittance/impedance analyzer 971 may be, but is not necessarily, connected to the data/control bus 908 via a link 904. The admittance/impedance analyzer 971 connects to an activated transducer 300 and analyzes the admittance or impedance of the activated transducer 300.

Based on the output of the admittance/impedance analyzer 971, the bimodal response detector 972, which may be, but is not necessarily, connected to the admittance/impedance analyzer 971 by a link 906, detects whether a bimodal response is present in the activated transducer 300. The bimodal response detector 972 may output whether a bimodal response is detected to the data control bus 902, where it is accessed by the controller 960 and/or the non-uniform segment detector 940.

When the bimodal response detector 972 detects that a bimodal response is present, the force applicator 973, which may be, but is not necessarily, connected to the data/control bus 902 via a link 908, applies a small dampening force, such as a force of from greater than zero to about five pounds, for example, to one of the waveguide segments 322. If the bimodal response disappears, the output of the bimodal response detector 972 changes to an output that shows that no bimodal response is detected. The non-uniform segment detector 940 then identifies the waveguide segment 322 to which the force applicator 973 is currently applying force as the target waveguide segment 322, or as one of the target waveguide segments 322, that needs to have its mass altered. The mass alteration system 950 then alters the mass of that target waveguide segment.

When the bimodal response detector 972 continues to detect a bimodal response even after the force applicator 973 has applied a force to a particular waveguide segment 322, the non-uniform segment detector 940 determines that the current waveguide segment 322 does not need its mass altered at this time. The force applicator 973 then applies force to another waveguide segment, and this process is repeated until a target waveguide segment is identified.

As stated, the pre-balancing system 970, and/or individual components of the pre-balancing system 970, may or may not be electrically and/or functionally connected to the data/control bus 902. Thus, the links 904, 906 and 908 are optional. For example, admittance/impedance analyzer 971, the bimodal response detector 972 and/or the force applicator 973 may operate independently of the other elements in the system. For example, a human operator may implement the functions of at least the bimodal response detector 972 and the force applicator 973 by visually observing the output of the admittance/impedance analyzer 971 and visually detecting a bimodal response, selectively applying force to individual waveguide segments with his or her finger, and manually inputting information to the transducer tuning system 900 to allow the transducer tuning system 900 to tune the transducer, and/or positioning the transducer so that it can be tuned by the transducer tuning system 900.

Alternatively, for example, the force applicator 973 may be automated and/or pre-programmed to operate in a predetermined force applying sequence based on commands and/or feedback from the controller 960 and/or other elements in the transducer tuning system 900.

The velocity uniformity determination system 980 determines a velocity uniformity, or a velocity uniformity deviation, based on the output of the velocometer. The output of the velocity uniformity determination system 980 can be used to determine whether the transducer is within an acceptable range of velocity uniformity deviation. The output of the velocity uniformity determination system 980 can also be used by the mass alteration amount determination system 990.

The mass alteration amount determination system 990 determines an amount by which to alter the mass of a specified waveguide segment that has been targeted to have its mass altered, based on the output of the velocometer 910 and/or the velocity uniformity determination system 980. The mass alteration amount determined by the mass alteration amount determination system 990 is then output to the mass alteration system 950, which responds by altering the mass of the targeted waveguide segment by the specified amount. The mass alteration amount determination system 990 may determine the mass alteration amount on the fly, or may determine the mass alteration amount by using a lookup table or the like.

The mass alteration amount determination system 990 is particularly well suited for use in a transducer tuning system 900 that has an automatic adhesive dispenser or the like (not shown) provided in the mass alteration system 950. In this case, when mass is to be added to a target waveguide segment, the adhesive dispenser meters and dispenses a precise amount of adhesive onto the surface of the waveguide segment in accordance with a signal received from the mass determination amount determination system 990.

It should be appreciated that the various elements of the transducer tuning system 900 described above may be implemented by software and/or hardware in any suitable combination. Additionally, as described above in connection with the force applicator 973, for example, a human operator may perform some of the control and/or other functions.

Additionally, it should be appreciated that two or more of the structures within the transducer tuning system shown in FIG. 8 may be incorporated in a single unit. For example, the velocometer 910, the memory 920, and/or the velocity profile generator 930 may be incorporated within a single unit. Moreover, while the transducer tuning system is shown as a single system incorporating various structures, it should be appreciated that various ones or combinations of the structures may operate externally and independently of the system. For example, the pre-balancing system may operate externally and independently of the other structures.

Figure 9:
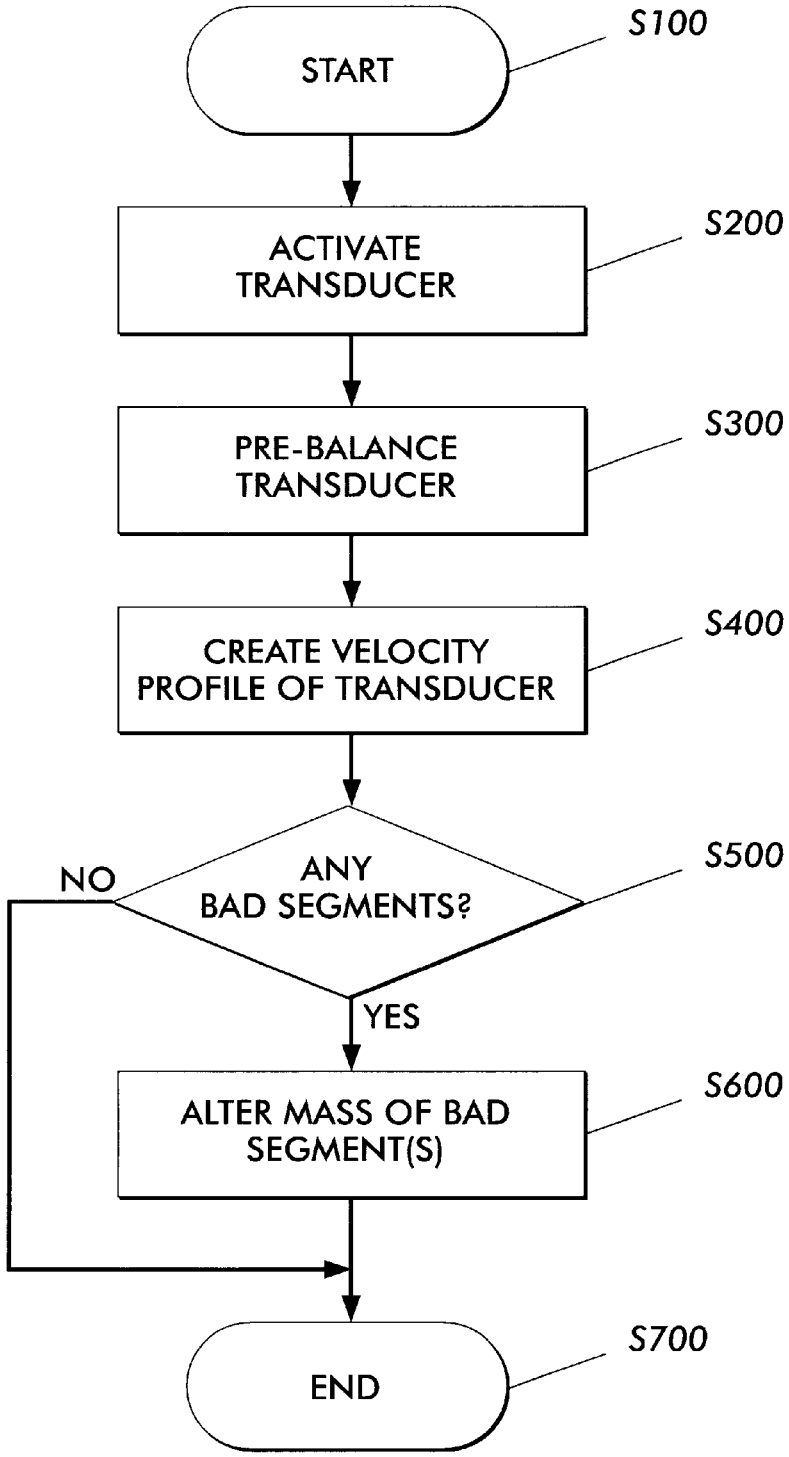
FIG. 9 is a flowchart outlining one exemplary embodiment of a method for tuning a transducer according to this invention.

FIG. 9 is a flowchart outlining one exemplary embodiment of a method for tuning a transducer according to this invention. Beginning in step S 100, control continues to step S200, where the transducer is activated. Next, in step S300, the transducer is pre-balanced. Then, in step S400, a velocity profile of the transducer is created. Control then continues to step S500. It should be appreciated, as indicated above, that pre-balancing the transducer is optional. Thus, if pre-balancing of the transducer is not necessary or desirable, step S300 can be omitted. In this case step S400 will follow step S200.

In step S500, a determination is made whether there are any bad waveguide segments, i.e., segments that are causing an unacceptable or undesirable response in the transducer. If there are no bad segments, control jumps to step S700. However, if there are any bad segments, control continues to step S600.

In step S600, the mass of the bad segment, or segments, is altered based at least in part on the determining velocity profile. Control then continues to step S700, where the method ends.

Figure 10:
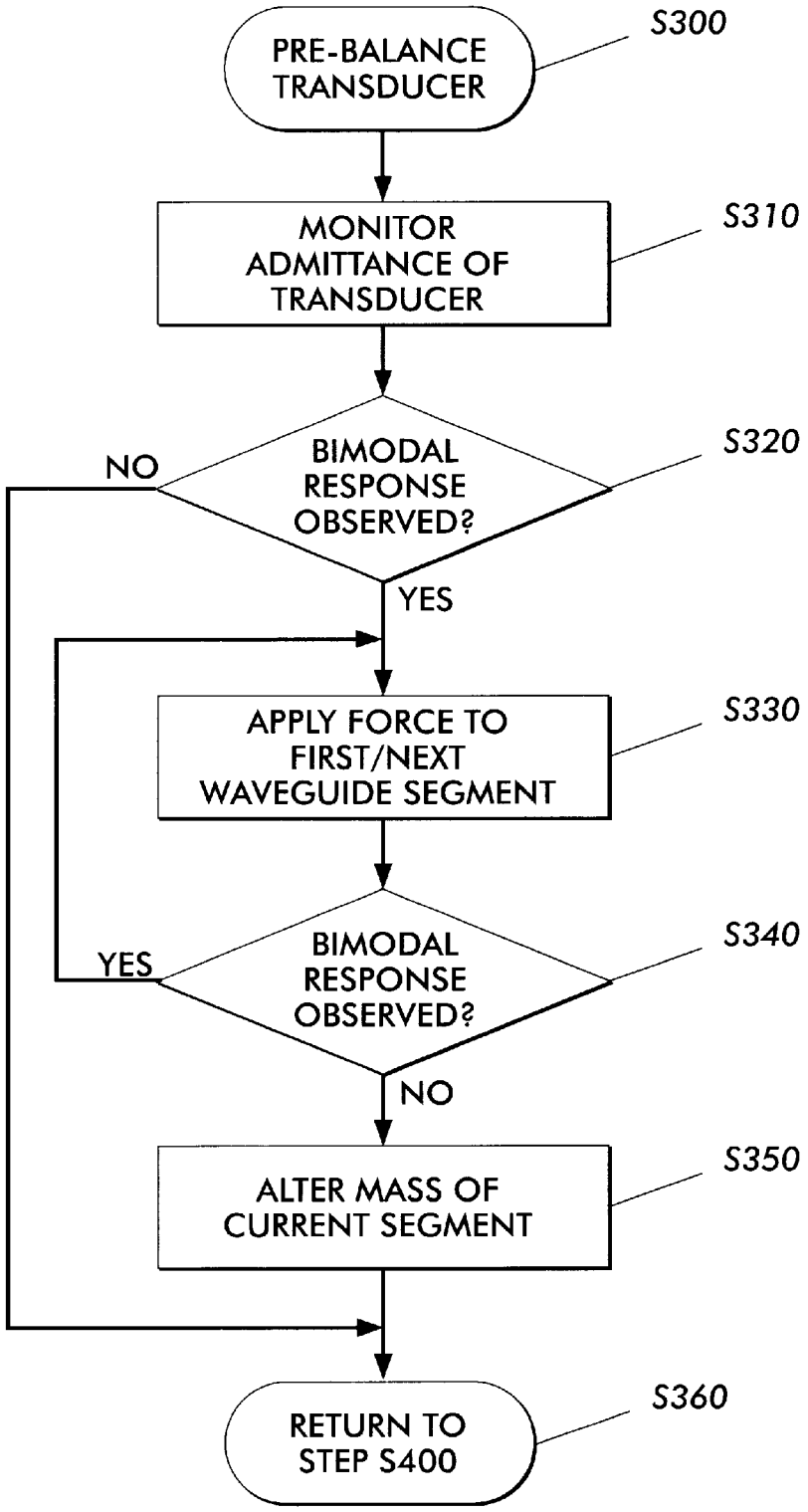
FIG. 10 is a flowchart outlining one exemplary embodiment of a method for pre-balancing a transducer prior to performing other steps of the method of FIG. 9.

FIG. 10 is a flowchart outlining one exemplary embodiment of a method for pre-balancing the transducer of step S300 of FIG. 9. Beginning in step S300, control continues to step S3 10, where admittance, or impedance, of the activated transducer is monitored. Next, in step S320, a determination is made whether the transducer is exhibiting a bimodal response. If no bimodal response is observed, control jumps to step S360. Otherwise, control continues to step S330.

In step S330, a force is applied to a waveguide segment 322. Then in step S340, another determination is made whether the bimodal response is still observed. If the bimodal response is still observed, control returns to step S330, so that force can be applied to a different waveguide segment 322. Otherwise, control continues to step S350.

In step S350, the mass of the current segment 322, i.e., the segment to which force has most recently been applied, is altered. Control then continues to step S360 where control returns to step S400 of FIG. 9.

In a variation of the exemplary embodiment of step S300 shown in FIG. 10, after step S350, rather than continuing to step S360, control jumps back to step S320, so that a determination can be made whether any bimodal response remains in the transducer.

Figure 11:
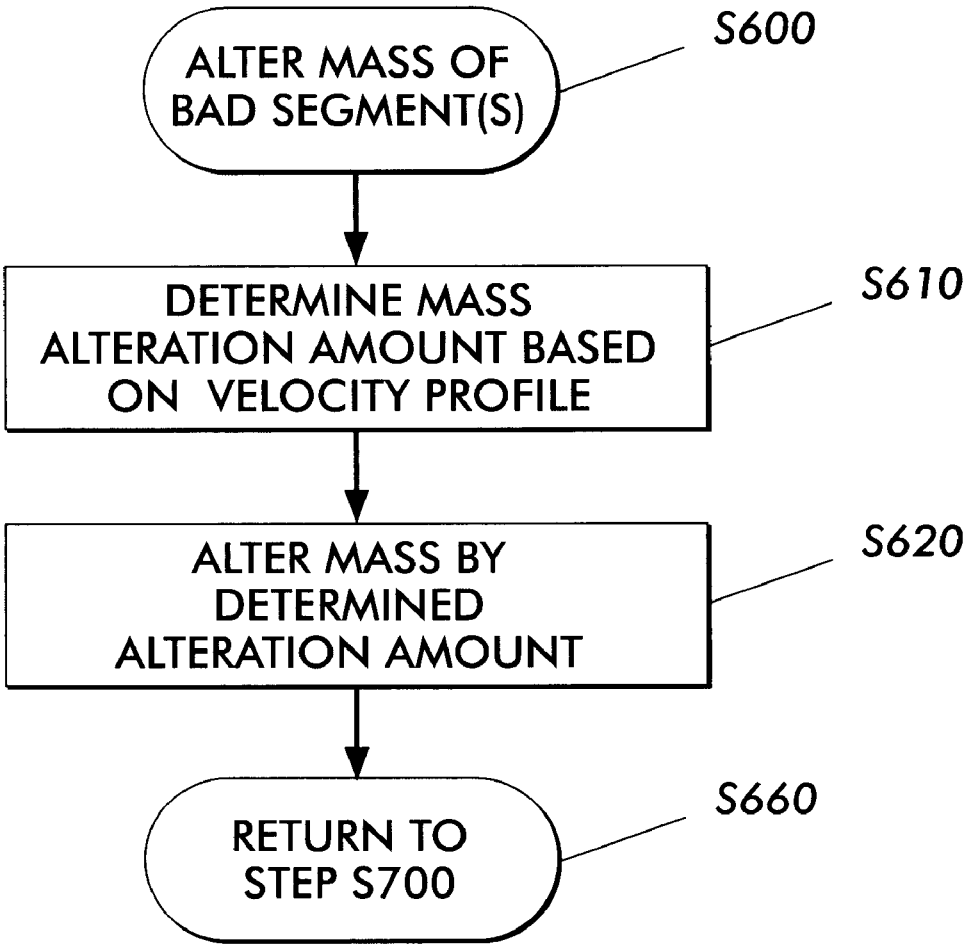
FIG. 11 is a flowchart outlining in greater detail one exemplary embodiment of a method for performing the step of altering the mass of a bad segment of FIG. 9.

FIG. 11 is a flowchart outlining in greater detail one exemplary embodiment of a method for altering the mass of one or more bad segments of step S600 of FIG. 9. Beginning in step S600, control continues to step S610, where a mass alteration amount is determined based on the velocity profile. The mass alteration amount may be determined on the fly, or may be obtained using a lookup table or the like. Next, in step S620, the mass of one or more of the one or more bad segments is altered based on the determined mass alteration amount. Then, in step S660, control returns to step S700.

Figure 12:
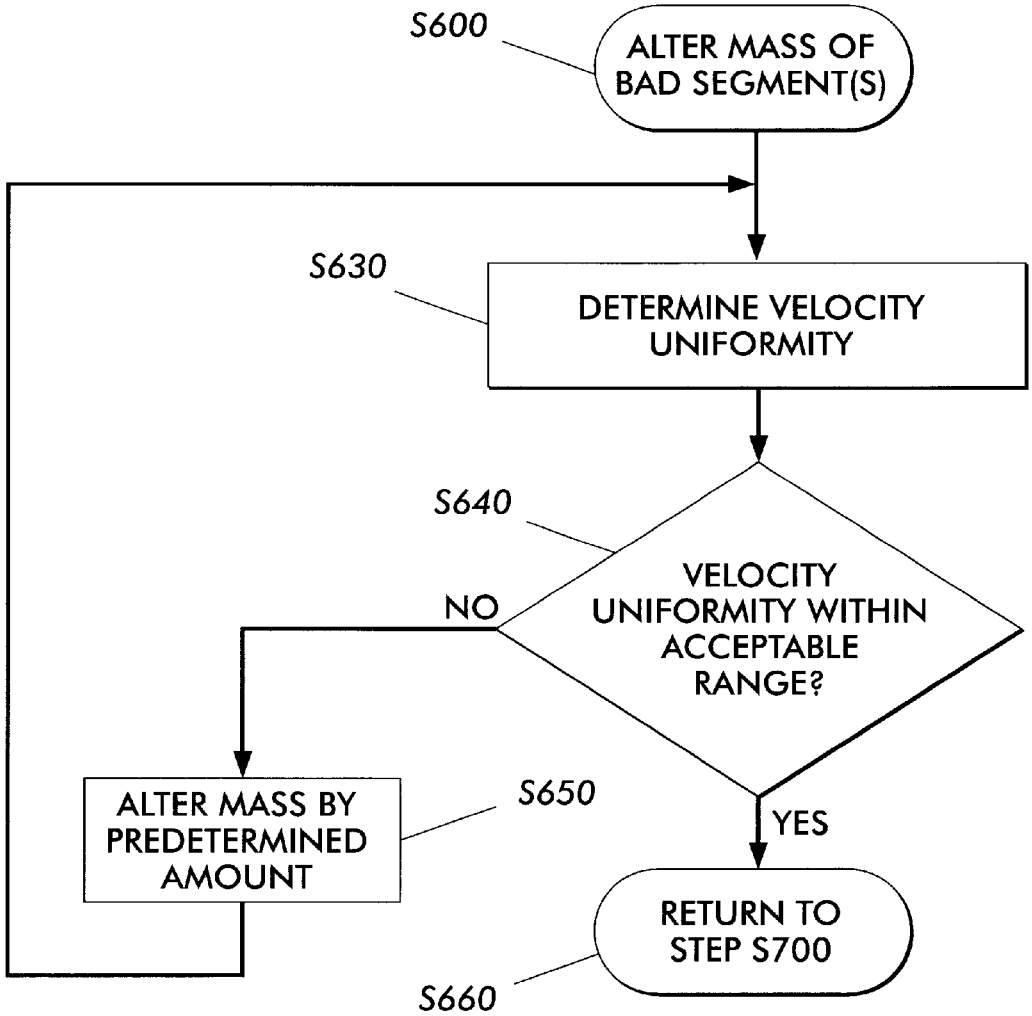
FIG. 12 is a flowchart outlining in greater detail another exemplary embodiment of a method for performing the step of altering the mass of a bad segment of FIG. 9.

FIG. 12 is a flowchart outlining in greater detail another exemplary embodiment of the method altering the mass of one or more bad waveguide segments of step S600 of FIG. 9. Beginning in step S600, control continues to step S630, where an initial velocity uniformity, or velocity uniformity deviation, is determined. It should be appreciated that, rather than being determined at this point in the control procedure, the initial velocity uniformity may have been determined at any previous point, such as, for example, directly after step S400 of FIG. 9. In this case, step S630 may actually be broken into two sub-steps-a first sub-step in which an initial velocity uniformity is determined, and which may be performed at any suitable point previous to the subsequent steps, and a second sub-step in which a velocity uniformity of a tuned, or partially tuned, transducer is detected, and which is performed after step S650, described below. Control then continues from step S630 to step S640.

In step S640 a determination is made whether the velocity uniformity is within an acceptable, or desirable, range. If the velocity uniformity is within an acceptable range, control jumps to step S660. Otherwise, control continues to step S650.

In step S650, the mass of one or more of the one or more bad waveguide segments is altered by a predetermined amount. The predetermined amount of alteration may be a standard amount, for example, or may have been determined or approximated based on velocity uniformity deviation or on one or more other criteria. Control then returns to step S630, so that the velocity uniformity can be re-determined. This process is repeated until it is determined in step S640 that the velocity uniformity is within an acceptable range.

It should be appreciated that, on the second and following iterations of step S650, the amount of mass applied or removed may or may not be the same as the amount applied during the first iteration. For example, in the first iteration, a 100 mg mass may be applied or removed, and in the second iteration, a 50 mg mass may be applied or removed. Alternatively, mass may be applied, or removed, in uniform increments of 50 mg, for example.

The transducer tuning system 900 is preferably implemented on a programmed general purpose computer. However, the transducer tuning system 900 can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing at least some portions of the flowcharts shown in FIGS. 9–12, can be used to implement the transducer tuning system 900.

While the invention has been described in conjunction with the specific embodiments described above, many equivalent alternatives, modifications and variations will become apparent to those skilled in the art once given this disclosure. Accordingly, the preferred embodiments of the invention as set forth above are considered to be illustrative and not limiting. Various changes to the described embodiments may be made without departing from the spirit and scope of the invention.

For example, this invention has, for effective illustration, been described in the context of an image reproducing apparatus. However, elongate transducers of this type have many applications in many fields. For example, ultrasonic welders, such as are used to seal plastic bags or the like, may effectively use transducers such as are disclosed and claimed in this application. Others in other fields will likely find many other uses for such transducers, especially in view of the anticipated cost reduction that will be gained by implementing this invention.

Additionally, in the specific usage context described above, a transducer is provided to operate in conjunction with a transfer station of an image reproduction system. However, those skilled in the art will appreciate that transducers of this type may also be used in conjunction with other stations or processes, such as a cleaning station or the like.

What is claimed is:

1. A transducer, comprising:

a vibratory energy producing element that generates vibratory energy; and a waveguide member coupled to the vibratory energy producing element and transmitting the vibratory energy, the waveguide member having a longitudinal axis and divided along the longitudinal axis into a plurality of waveguide segments, wherein a mass of at least one of the waveguide segments has been altered.

2. The transducer of claim 1, wherein the altered mass of the at least one waveguide segment is an increased mass.

3. The transducer of claim 2, wherein the increased mass is provided as a specified amount of hardenable adhesive applied to surface of the at least one waveguide segment.

4. The transducer of claim 2, wherein the increased mass is provided as a specified amount of adhesive tape applied to a surface of the at least one waveguide segment.

5. The transducer of claim 2, wherein the increased mass is provided as a specified amount of material, having a density greater than a density of the at least one waveguide segment, mechanically engaged with the at least one waveguide segment.

6. The transducer of claim 1, wherein the altered mass of the at least one waveguide segment is a decreased mass.

7. The transducer of claim 6, wherein the decreased mass results from a cavity formed in the at least one waveguide segment.

8. The transducer of claim 1, wherein at least one of the at least one waveguide segments is positioned next to an end-most one of the plurality of waveguide segments.

9. The transducer of claim 1, wherein a mass of at least two of the waveguide segments has been altered, the altered mass of a first one of the at least two waveguide segments being an increased mass and the altered mass of a second one of the at least two waveguide segments being a decreased mass.

10. The transducer of claim 1, wherein the altered mass of the at least one waveguide segment reduces a velocity profile deviation of the waveguide member.

11. A method of tuning a transducer comprising a vibratory energy producing element that generates vibratory energy and a waveguide member coupled to the vibratory energy producing element and transmitting the vibratory energy, the waveguide member having a longitudinal axis and divided along the longitudinal axis into a plurality of waveguide segments, the method comprising:

activating the transducer;

scanning a velocity of at least some of the waveguide segments to create a velocity profile of the transducer;

detecting at least one non-uniform waveguide segment causing unacceptable velocity uniformity deviation based on the velocity profile; and altering a mass of the at least one non-uniform waveguide segment.

12. The method of claim 11, wherein altering the mass comprises decreasing the mass.

13. The method of claim 11, wherein altering the mass comprises increasing the mass.

14. The method of claim 11, wherein altering the mass comprises decreasing the mass of a first waveguide segment and decreasing the mass of a second waveguide segment.

15. The method of claim 11, further comprising:

monitoring an impedance or an admittance of the activated transducer;

detecting a bimodal response based on the monitored impedance or admittance;

successively applying force to individual ones of the waveguide segments until the bimodal response ceases; and identifying the waveguide segment to which force was applied when the bimodal response ceased as a waveguide segment whose mass should be altered.

16. The method of claim 15, wherein successively applying force comprises applying force at least to a waveguide segment in a predetermined position among the plurality of waveguide segments.

17. The method of claim 16, wherein the predetermined position is an empirically and/or analytically determined position.

18. The method of claim 16, wherein successively applying force comprises applying, if the bimodal response does not cease when force is applied to the predetermined waveguide segment, force to another waveguide segment.

19. The method of claim 11, further comprising:

determining a velocity uniformity deviation of the transducer based on the velocity profile;

determining an amount by which to alter the mass of the at least one waveguide segment based on the determined velocity uniformity deviation; and altering the mass of the at least one waveguide segment by the determined amount.

20. The method of claim 11, wherein altering the mass of the at least one waveguide segment comprises altering the mass of the at least one waveguide segment by a first predetermined amount.

21. The method of claim 20, further comprising:

determining a velocity uniformity deviation of the transducer with the altered mass;

determining whether the velocity uniformity deviation is within an acceptable range; and altering the mass of the at least one waveguide segment by a second predetermined amount if it is not within the acceptable range.

22. The method of claim 21, wherein the acceptable range of the velocity uniformity deviation is from 0 to about 50%.

23. The method of claim 21, wherein the acceptable range of the velocity uniformity deviation is from 0 to about 20%.

24. The method of claim 21, wherein the first predetermined amount is equal to the second predetermined amount.

25. The method of claim 21, wherein the first predetermined amount is different from the second predetermined amount.

26. A system for tuning a transducer comprising a vibratory energy producing element that generates vibratory energy and a waveguide member coupled to the vibratory energy producing element and transmitting the vibratory energy, the waveguide member having a longitudinal axis and divided along the longitudinal axis into a plurality of waveguide segments, the system comprising:

a velocometer that outputs a velocity signal representative of a velocity of at least one of the plurality of waveguide segments or of the transducer;

a non-uniform waveguide segment detector that detects at least one non-uniform waveguide segment based on a velocity profile generated from the velocity signal; and a mass alteration system that alters a mass of the detected at least one non-uniform waveguide segment.

27. The system of claim 26, wherein the mass alteration system comprises a mass decreasing system that decreases the mass by forming a cavity at least partially through the detected at least one non-uniform waveguide segment.

28. The system of claim 26, wherein the mass alteration system comprises a mass increasing system that applies mass to a surface of the detected at least one non-uniform waveguide segment.

29. The system of claim 28, wherein the applied mass comprises a hardenable adhesive.

30. The system of claim 28, wherein the applied mass comprises adhesive tape.

31. The system of claim 28, wherein the applied mass comprises a specified amount of material, having a density greater than a density of the at least one non-uniform waveguide segment, mechanically engaged with the at least one non-uniform waveguide segment.

32. The system of claim 26, wherein the mass alteration system comprises a mass decreasing system and a mass increasing system.

33. The system of claim 26, further comprising a pre-balancing system, the pre-balancing system comprising:

one of an impedance analyzer and an admittance analyzer;

a bimodal response detector that detects a bimodal response based on an impedance or an admittance analyzed by the impedance analyzer or the admittance analyzer;

a force applicator that successively applies force to individual ones of the waveguide segments until the bimodal response detector no longer detects the bimodal response; and a controller that controls the mass altering system to alter the mass of at least the waveguide segment to which force was applied when the bimodal response was no longer detected by the bimodal response detector.

34. The system of claim 33, wherein the force applicator applies force to a waveguide segment in a predetermined position among the plurality of waveguide segments.

35. The system of claim 34, wherein the predetermined position is an empirically and/or analytically determined position.

36. The system of claim 34, wherein, if the bimodal response is still detected by the bimodal response detector after force is applied to the waveguide segment in the predetermined position, the force applicator applies force to another waveguide segment.

37. The system of claim 26, further comprising:

a velocity uniformity deviation determination system that determines a velocity uniformity deviation based on the velocity profile; and a controller that controls the mass alteration system to alter the mass of the detected at least one non-uniform waveguide if the velocity uniformity deviation determined by the velocity uniformity deviation determination system is outside an acceptable range.

38. The system of claim 37, further comprising a mass alteration amount determination system that determines an amount by which to alter the mass of the at least one waveguide segment based on the velocity uniformity deviation determined by the velocity uniformity deviation determination system, wherein the mass determination system alters the mass by the amount determined by the mass alteration amount determination system.

39. The system of claim 37, wherein the mass alteration system alters the mass of the at least one waveguide segment by a first predetermined amount.

40. The system of claim 39, wherein the velocity uniformity deviation determination system re-determines the velocity uniformity deviation of the transducer with the altered mass, and the mass alteration system alters the mass by a second predetermined amount if the re-determined velocity uniformity deviation is not within the acceptable range.

41. The system of claim 40, wherein the first predetermined amount is equal to the second predetermined amount.

42. The system of claim 40, wherein the first predetermined amount is different from the second predetermined amount.

43. The system of claim 37, wherein the acceptable range of the velocity uniformity deviation is from 0 to about 50%.

44. The system of claim 37, wherein the acceptable range of the velocity uniformity deviation is from 0 to about 20%.

45. The method of claim 26, wherein the mass alteration system alters the mass by a predetermined amount.

46. An image reproducing system comprising:

an image bearing member that moves in a process direction and bears an image to be reproduced, the image contained within an active width of the image bearing member;

a transducer that applies vibratory energy to the image bearing member, the transducer arranged in a direction transverse to the process direction and having a length greater than or equal to the active width, the transducer comprising:

a vibratory energy producing element that generates vibratory energy; and a waveguide member coupled to the vibratory energy producing element and transmitting the vibratory energy to the image bearing member, the waveguide member having a longitudinal axis and divided along the longitudinal axis into a plurality of waveguide segments, a mass of at least one of the waveguide segments having been altered.

* * * * *